US009313570B1

(12) United States Patent
Hagman

(10) Patent No.: US 9,313,570 B1
(45) Date of Patent: Apr. 12, 2016

(54) WATERPROOF SPEAKER SYSTEM WITH BLADDER

(71) Applicant: Paul N Hagman, Mount Vernon, WA (US)

(72) Inventor: Paul N Hagman, Mount Vernon, WA (US)

( * ) Notice: Subject to any disclaimer, the term of this patent is extended or adjusted under 35 U.S.C. 154(b) by 317 days.

(21) Appl. No.: 13/889,672

(22) Filed: May 8, 2013

Related U.S. Application Data

(63) Continuation-in-part of application No. 13/603,196, filed on Sep. 4, 2012, now Pat. No. 9,008,342.

(51) Int. Cl.
*H04R 9/06* (2006.01)
*H04R 1/44* (2006.01)

(52) U.S. Cl.
CPC ..... *H04R 1/44* (2013.01)

(58) Field of Classification Search
CPC ..... H04B 13/02; H04B 11/00; H04R 1/44; H04R 1/02; H04R 1/023; H04R 1/028; H04R 1/021; H04R 1/025; H04R 1/026; H04R 1/086; H04R 1/1058; H04R 1/1066; H04R 2499/11; H04R 2499/13; H04R 2201/023; H04R 5/02; H04R 5/023; H04R 2420/07; H04R 9/06; H04R 31/00; H04M 1/18; H04M 1/03; H04M 1/035; H04M 1/6041; H04M 1/0212; H04M 1/00; B60R 11/0217; G01V 2210/10; H01R 13/00
USPC ..... 381/61, 80, 87, 89, 98, 332, 333, 334, 381/335, 345, 386, 391, 189, 361, 366, 300, 381/301, 302, 303, 304, 305, 306, 308, 100, 381/152, 337, 351, 161, 162, 167; 353/15, 353/18, 19; 181/150, 199; 348/40, 14.07; 81/149, 160, 235, 238, 247, 248
See application file for complete search history.

(56) References Cited

U.S. PATENT DOCUMENTS

| | | | | |
|---|---|---|---|---|
| 4,926,398 | A | 5/1990 | Fincher | |
| 5,136,549 | A | 8/1992 | Berglund | |
| 5,406,531 | A * | 4/1995 | Henriquez et al. | 367/157 |
| 6,396,769 | B1 | 5/2002 | Polany | |
| 7,292,702 | B2 | 11/2007 | Hagman | |
| 9,008,342 | B1 | 4/2015 | Hagman | |
| 2005/0067216 | A1 | 3/2005 | Schuhmann et al. | |
| 2012/0134518 | A1 | 5/2012 | Otani et al. | |
| 2013/0156243 | A1 * | 6/2013 | Hagman | 381/333 |

FOREIGN PATENT DOCUMENTS

| | | | |
|---|---|---|---|
| FR | 2907069 | 4/2008 | |
| WO | WO 2007008014 A1 * | 1/2007 | H04B 1/38 |

* cited by examiner

*Primary Examiner* — Leshui Zhang
(74) *Attorney, Agent, or Firm* — Dwayne E. Rogge; Schacht Law Office, Inc.

(57) ABSTRACT

Disclosed herein is a waterproof speaker system for use in residential and commercial applications. The disclosed speaker system is particularly applicable to wet conditions with large temperature changes such as greenhouses, gardens, boats, and other outdoor installations or where traditional speakers are negatively affected by water, temperature changes, and humidity. The waterproof speaker system generally comprises a solid water impermeable cast rear and side casing, and internal front frame member housing the speaker drivers and in some cases a simple electronics or amplification circuit, and a water impermeable front face panel sealed to the front frame member and/or the rear casing to completely enclose the speaker driver from contact with moisture.

9 Claims, 9 Drawing Sheets

WATERPROOF SPEAKER SYSTEM WITH BLADDER

RELATED APPLICATIONS

This application claims priority benefit of, and is a continuation in part of U.S. patent application Ser. No. 13/603,196 filed on Sep. 4, 2012 incorporated herein by reference.

BACKGROUND OF THE DISCLOSURE

Field of the Disclosure

This disclosure relates to the field of waterproof speaker enclosures with an interior pressure bladder. In particular, the disclosure relates to a speaker system using an acoustic lever model of resonance.

SUMMARY OF THE DISCLOSURE

A waterproof speaker system is disclosed herein comprising in one example a water impermeable rear casing cast as a unitary body with a rear panel, and side panels substantially orthogonal to the rear panels. A front frame cast as a unitary body and having a perimeter edge is sealed to an interior surface of the side panels of the rear casing. In this example a water impermeable front face panel is sealed to a perimeter face of the front frame and the front frame has a surface defining a driver void therethrough having substantially the same shape as the perimeter edge of a low frequency speaker driver. The perimeter edge of the low frequency speaker driver is attached to the surface defining the driver void such that the low frequency speaker driver is not in contact with the front face panel. A rear surface of the front face panel, front surface of the front frame, front surface of the low frequency speaker driver and offset edge define an offset void allowing the front face panel to oscillate without contacting the front face frame or low frequency speaker driver. A speaker wiring stud is sealed to and projects through the casing to provide electrical communication to the low frequency speaker driver.

The waterproof speaker system as recited herein may further comprise a resilient member compressed between a rear surface of the low frequency speaker driver and a front facing surface of the rear casing.

The waterproof speaker system as recited herein may be arranged wherein the resilient member is adhered to one or both of the rear surface of the low frequency speaker driver and front facing surface of the rear casing.

The waterproof speaker system as recited herein may further comprise a compressible foam tape with adhesive on both sides thereof providing adhesion between the rear surface of the low frequency speaker driver and front facing surface of the rear casing.

The waterproof speaker system as recited herein may further comprise a volume of water impermeable sealant between the perimeter edge of the front frame and interior surface of the casing.

The waterproof speaker system as recited above may further comprise a volume of water impermeable sealant between the front face panel and the front frame.

The waterproof speaker system may be arranged wherein the rear casing is cast of Acrylonitrile Styrene Acrylate (ASA) Plastic.

A speaker mounting system is disclosed in one example comprising a speaker casing comprising a bracket attachment system comprising a plurality of bracket attachment points including:

- a landscape flat attachment point allowing the speaker casing to be mounted to a vertical surface where the front face panel of the speaker is substantially parallel to the vertical surface in a landscape orientation;
- a portrait flat attachment point allowing the speaker casing to be mounted to a vertical surface where the front face panel of the speaker is substantially parallel to the vertical surface in a portrait orientation;
- a landscape angled attachment point allowing the speaker casing to be mounted to a vertical surface where the front face panel of the speaker is at a substantial angle to the vertical surface in a landscape orientation;
- a portrait angled attachment point allowing the speaker casing to be mounted to a vertical surface where the front face panel of the speaker is at a substantial angle to the vertical surface in a portrait orientation.

A rigid bracket is also disclosed which may be removably attached to the speaker casing at one of the bracket attachment points. The bracket comprising one or more attachment locations where the speaker casing may be mounted to or rest upon a support structure.

The speaker mounting system as recited herein may be arranged wherein the landscape flat attachment point allows the speaker casing to rest upon to a horizontal surface in a landscape orientation without attachment to the horizontal surface; and the portrait flat attachment point allows the speaker casing to rest upon to a horizontal surface in a portrait orientation without attachment to the horizontal surface.

DESCRIPTION OF THE PREFERRED EMBODIMENTS

Disclosed herein is a waterproof speaker system for use in residential and commercial applications. The disclosed speaker system is particularly applicable to wet conditions such as found in greenhouses, gardens, boats, and other outdoor installations where traditional speakers are negatively affected by water, humidity and temperature changes.

Before continuing with the detailed description, an axes system 10 is disclosed in the Figures generally comprising a long axis 12 and a transverse axis 14. A short axis 16 is also disclosed. These axes are intended to aid in description of the disclosure and are not intended to be read into limitations of the claims. The speaker system can be oriented in generally any direction and still function as required.

Figure 1:
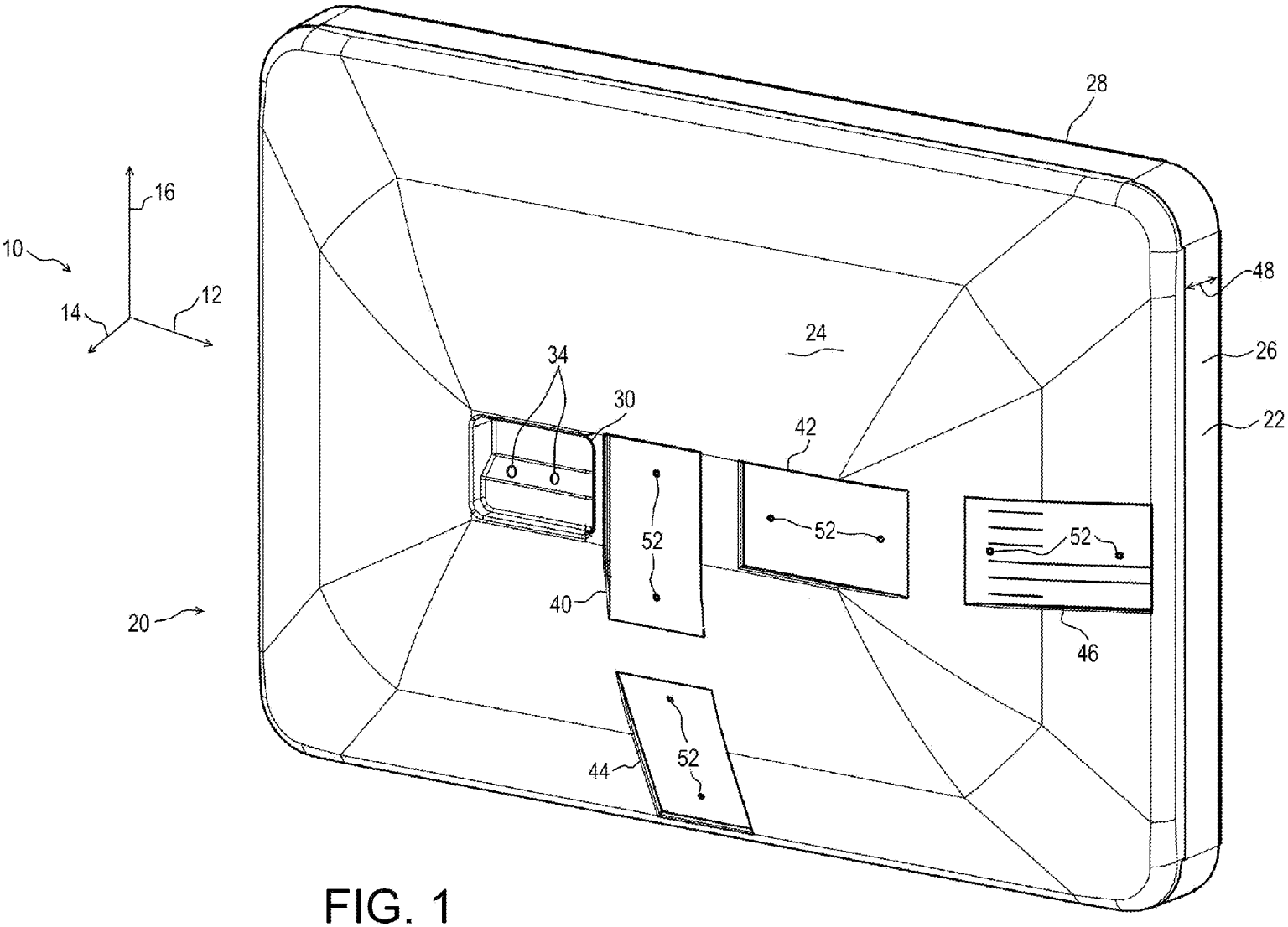
FIG. 1 is a rear isometric view of one example of the disclosed apparatus.
Figure 7:
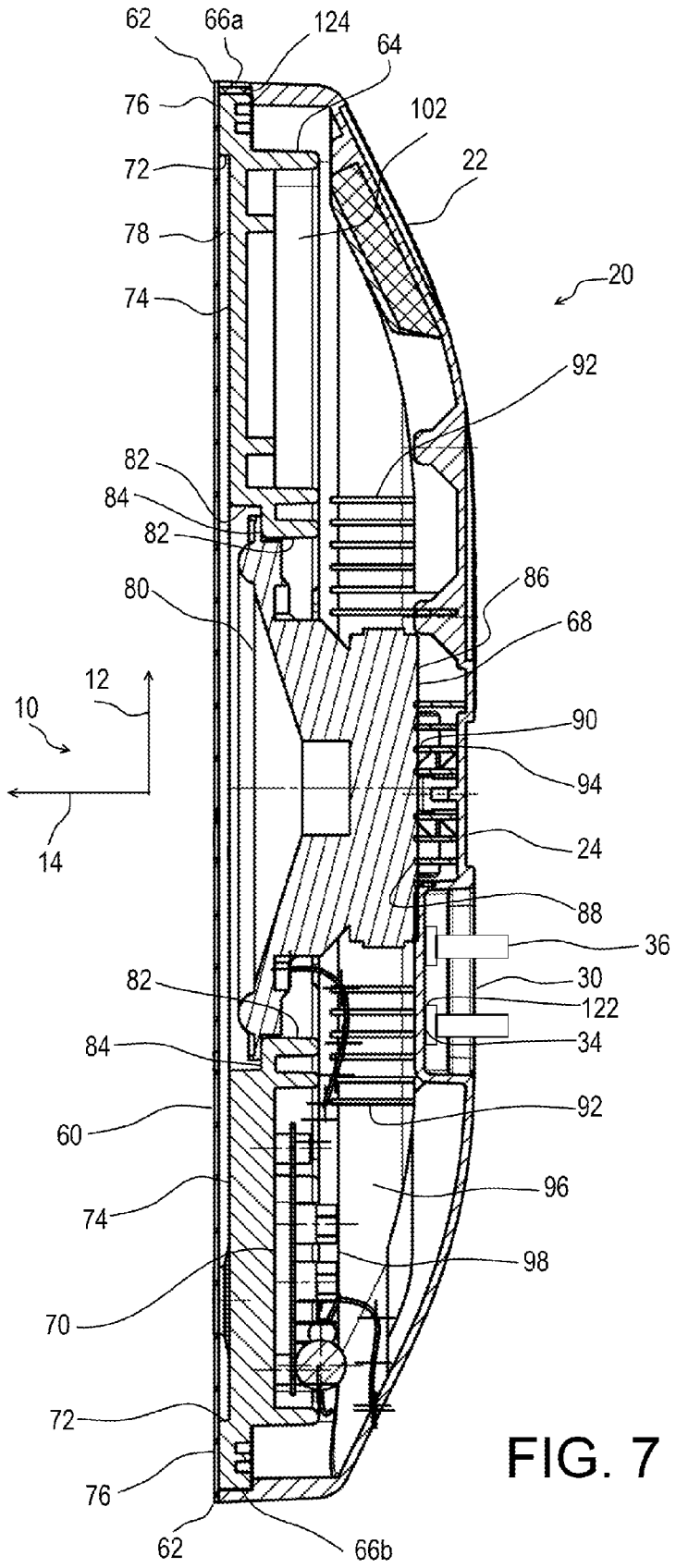
FIG. 7 is a top cutaway view of the example shown in FIG. 2.
Figure 11:
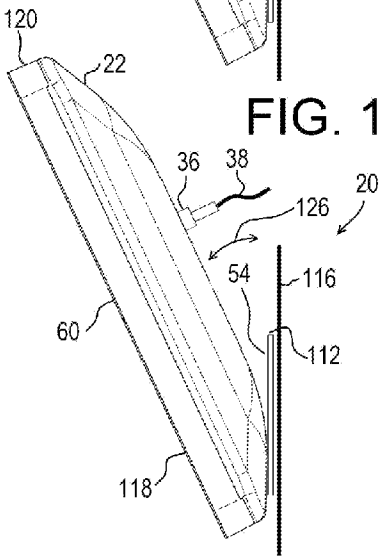
FIG. 11 is a side parallel view of the example shown in FIG. 1 in a portrait angled mounted position.

Looking to FIG. 1, the waterproof speaker system 20 is shown from the back side thereof. The rear casing 22 of the system 20 can be clearly seen including a rear surface 24 and perimeter edges 26/28. Also shown is a wiring recess 30 which is provided with a plurality of stud voids 34. In this example, upon complete assembly, studs 36 as shown in FIGS. 7 and 11 are mounted into the stud voids 34 to allow for easy attachment of wires 38 (FIG. 11) providing electrical communication from a stereo or other audiovisual equipment to the speaker drivers within the casing 22 while maintaining a hermetic seal. An O-ring 122 may be pressed between each stud 36 and the casing 22 to seal the stud void 34 and prohibit fluid entry.

Figures 8, 9:
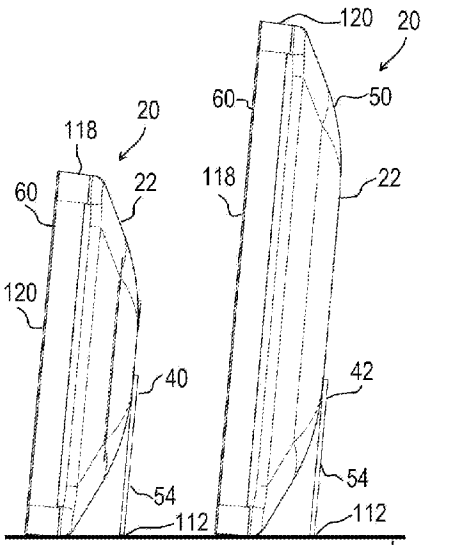
FIG. 8 is a side parallel view of the example shown in FIG. 1 in a landscape standing position.
FIG. 9 is a side parallel view of the example shown in FIG. 1 in a portrait standing position.

While the rear casing 22 can be provided in different shapes and/or sizes the design provided herein facilitates a shallow transverse depth 48 at the perimeter edge. An example utilizing a substantially rounded back portion 50 is shown in FIG. 9 provides an aesthetically pleasing assembly with a low visual impact.

In one form, the rear casing 22 is formed of a polymer cast as a unitary body. Testing has shown that a rear casing 22 cast of Acrylonitrile Styrene Acrylate (ASA) Plastic provides a sufficiently rigid structure with high ultraviolet protection providing a long-lasting housing while not negatively affecting the audio characteristics thereof.

Figure 14:
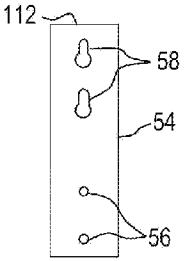
FIG. 14 is a front view of one example of a rigid bracket such as shown in FIGS. 8-13.

Looking back to the example of FIG. 1, several bracket attachment positions are shown for attachment of the example bracket 54 shown in FIG. 14 including: a landscape flat attachment position 40; a portrait flat attachment position 42; a landscape angled attachment position 44; and a portrait angled attachment position 46. These attachment positions will be described in more detail below. While a plurality of holes 52 are shown provided in each of the attachment position 40-46, generally these holes are blind (not through casing 22) and do not provide a fluid conduit into the interior portion of the casing 22.

Looking to FIG. 14, it can be seen how the example bracket 54 may be provided with surfaces defining mounting holes 56 through which fasteners such as screws, rivets, or other fasteners may pass and be received by the surfaces defining holes 52. In addition, T-slots 58 may be provided in the bracket 54 through which fasteners pass when the speaker system 20 is mounted in the orientations shown in FIGS. 10-13. These fasteners will generally be attached to the wall or vertical structure with an enlarged head at the distal end of the fastener. Such T-slot attachment is well known in the art.

Figure 2:
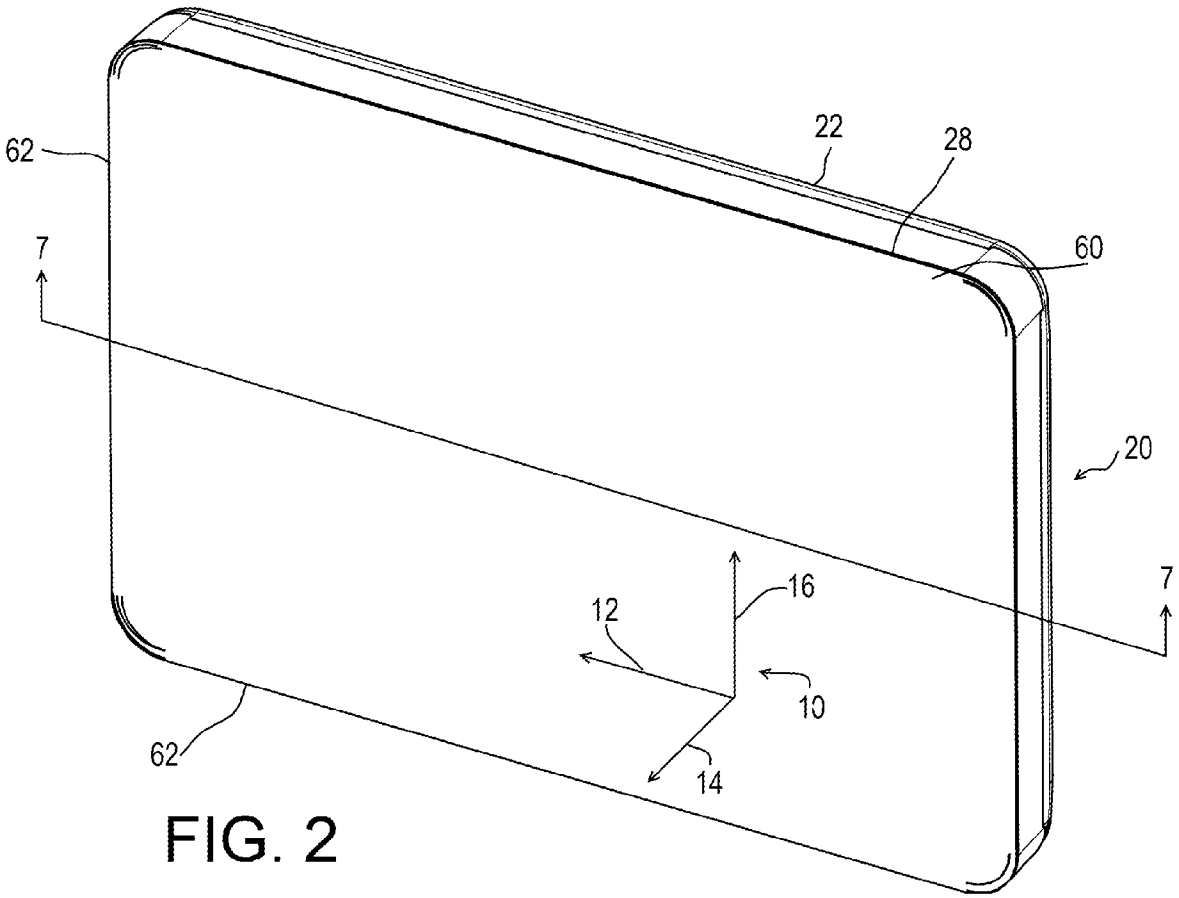
FIG. 2 is a front isometric view of the example shown in FIG. 1.

Looking to FIG. 2, it can be seen that the waterproof speaker assembly 20 includes a front face panel 60 which covers the front portion of the waterproof speaker assembly 20. In this example, the front face panel 60 generally extends to the perimeter edges 26/28 of the casing 22. While many different materials can be utilized for the front face panel 60 including extruded polystyrene, foam core, other polymers, organic sheet goods, etc., testing has shown that a layer of fiberglass or carbon fiber set in resin or similar hardening agent forms a water impermeable surface with exceptional acoustic qualities and resistance to sunlight and small impacts often encountered in the environments into which the speaker assemblies will be utilized. Such fiber reinforced plastics (FRP) are well known in the arts of boatbuilding etc. A layer of gelcoat may be used to provide a high quality finish on the visible surface of the FRP and/or to provide additional water impermeability and UV protection.

Looking to FIG. 7, a cross-sectional view of the waterproof speaker system 20 is shown as taken along line 7-7 of FIG. 2. This Fig. clearly shows the rear casing 22 encapsulating the rear portion of the speaker system 20 and in this example generally the edges of the casing 22 contact the outer edges 62 of the front face panel 60.

Figure 3:
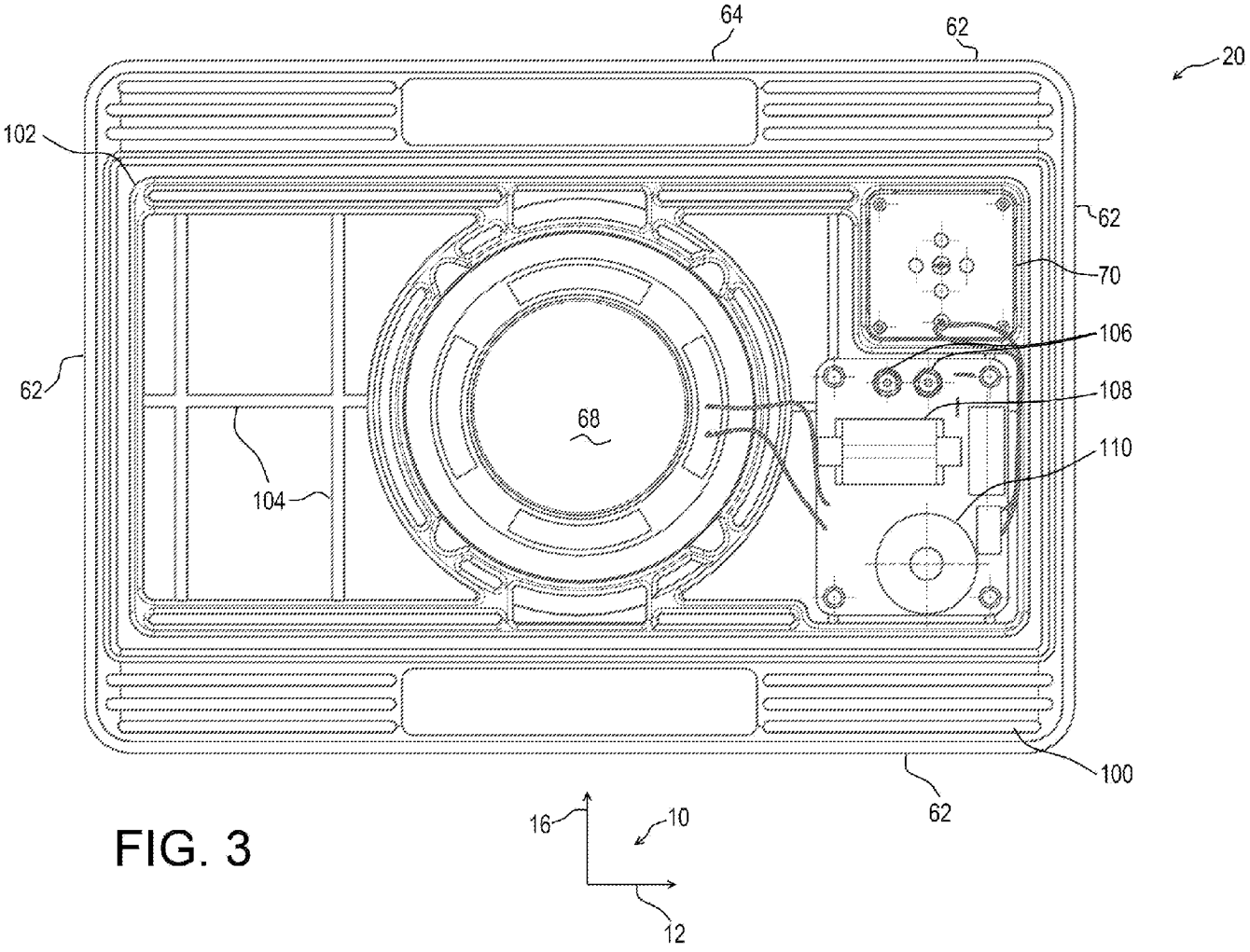
FIG. 3 is a rear parallel view of the internal components of the example shown in FIG. 1.

A frame 64 as shown in FIG. 3 is placed into the casing 22 as shown in FIG. 7 wherein the frame 64 extends in the long direction 12 from a perimeter edge 66*a* to a perimeter edge 66*b* on the opposing long side. In one form, the frame 64 including the front race panel 60 is sealed/adhered/fastened to the interior perimeter surface of the rear casing 22 at this perimeter edge. In one form, a volume of silicone sealant adhesive 124 is utilized. Such sealant/adhesive cures to a malleable state to maintain a waterproof seal.

This design and assembly effectively creates a waterproof and hermetically sealed enclosure for the speaker drivers 68 and 70. While previous "waterproof" speakers have been attempted in the past, normally the front face of such a prior speaker driver is exposed to water, and only the wiring and electronics regions are truly sealed. This allows for deterioration of the speaker driving surface itself.

In one example, one driver 68 is a low-frequency element or "woofer", while another speaker driver 70 is a high-frequency element or "tweeter". Other speaker drivers or combinations of drivers may be utilized including a single or plural driver for a wide range of acoustic capabilities, or alternatively a single speaker driver mounted within a housing which may interoperate with nearby speaker systems having speaker drivers of alternate acoustical ranges. For example, a "woofer" may be provided in a first casing, while a "tweeter" may be used in an adjacent casing.

As can be seen in the cross-sectional view of FIG. 7, in one example an offset edge 72 is provided extending transversely forward from an inner front face 74 of the frame 64. The offset edge 72 is positioned inward from the perimeter edges of the casing to allow the inner face of the front face panel 62 to be coupled at location 76 to the frame 64 while maintaining an offset void 78 between the front face panel 60 and the front face 74 of the frame 64. In use, the driving surface 80 of the driver 68 will oscillate and create a pressure wave within the offset void 78 causing the front face panel 60 to oscillate and function as a face of the speaker driver. Generally, this is known as an acoustic lever described in U.S. Pat. No. 7,292,702 incorporated herein by reference. In the example shown, the speaker driver 70 may be in contact with and/or attached to the inner face of the front face panel 60 to directly oscillate the front face panel 60 at different operating frequencies than the speaker driver 68.

In this example as shown in FIG. 7, the frame 64 comprises a surface defining a driver void 82 through the frame 64, and a shelf 84 to which the driver 68 is mounted. The driver 68 may be mounted (attached) by way of adhesive, fasteners, or similar methods. In addition, to provide a waterproof speaker system 20 with a relatively thin profile and rugged construction, the rear surface 86 of the driver 68 may be in contact with the inner forward facing surface 88 of the casing 22 or ridges extending inward therefrom. In some experiments, it has been found that such contact resulted in (intermittent) vibration between the surfaces as the driver 68 oscillated. To counter this vibration in an endeavor to improve durability and function, a resilient (elastic) member 90 may be provided between the rear surface 86 of the driver 68 and the inner front surface 88 of the casing 22.

A volume of silicone adhesive or many similar resilient adhesive materials may be utilized as this resilient member 90, including non-fluid resilient materials such as rubber, Sorbothane, etc., with or without adhesive, one example product has been found comprising a rubber like material in tape form with a strong adhesive on the front and rear faces thereof. During assembly, a portion of this material is placed between the rear surface 86 of the driver 68 and the inner forward facing surface 88 of the rear casing 22 and thus positioned there as the frame 64 is installed into the rear casing 22.

To increase rigidity of the rear casing 22, ridges 92 and 94 may be cast or otherwise provided. While the cutaway view shows the use of such ridges in one orientation, such ridges may also be provided bilaterally if desired. For example, ridges 92 may be generally aligned with the short axis 16 while ridges 96 are generally aligned with the long axis 12.

In the example shown in FIG. 7, the resilient member/material 90 is provided on the inner front surface 88 of the ridges 94 providing an exemplary support for the driver 68.

Figure 4:
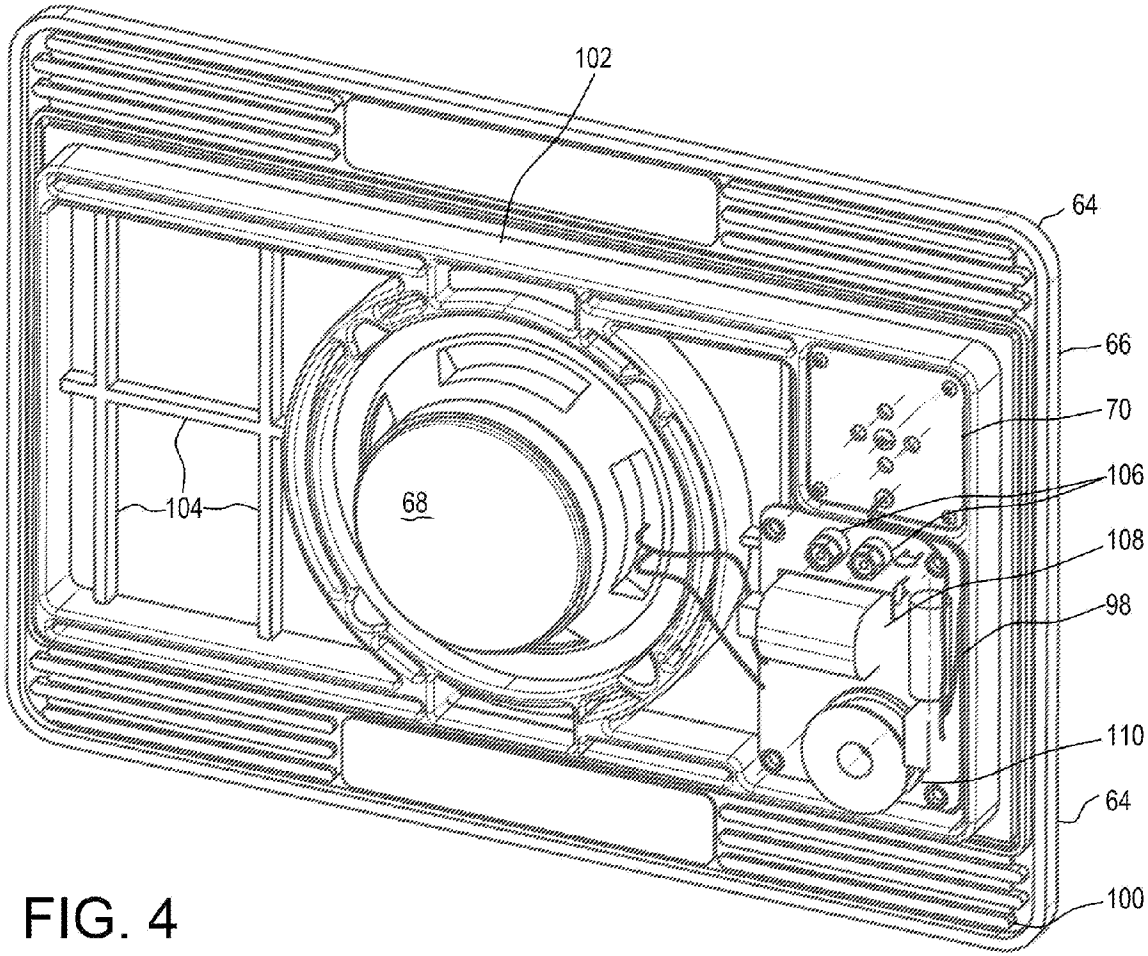
FIG. 4 is a rear isometric view of the example shown in FIG. 3.
Figure 5:
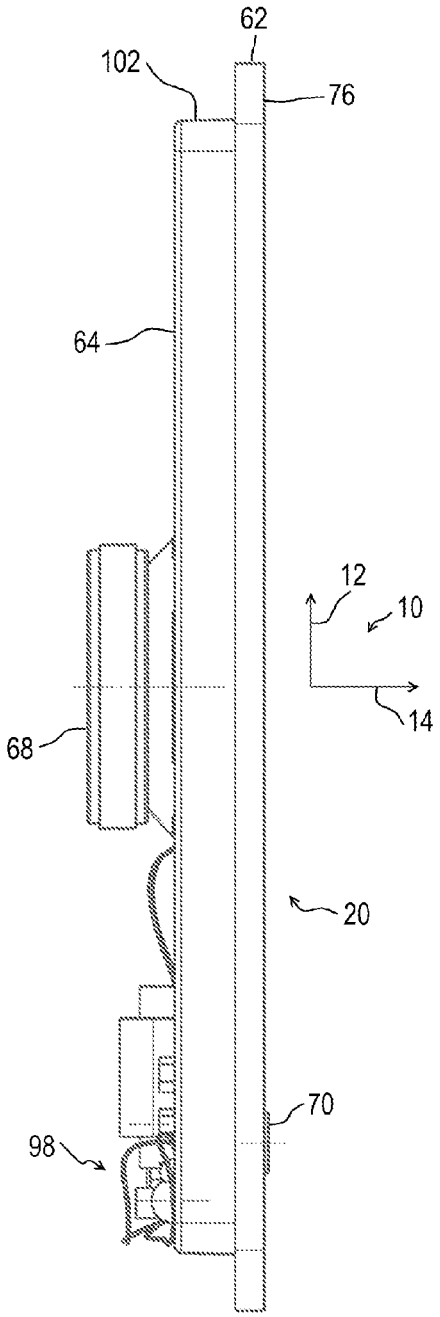
FIG. 5 is a side parallel view of the example shown in FIG. 3.
Figure 6:
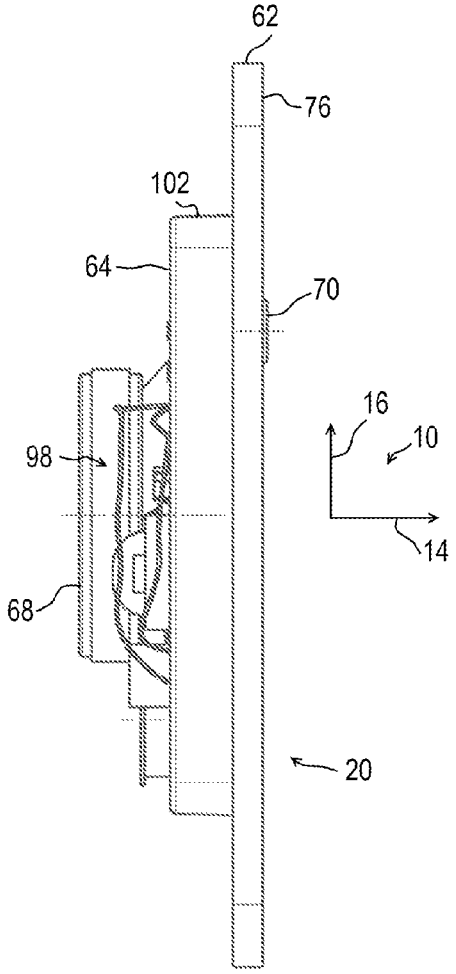
FIG. 6 is a top parallel view of the example shown in FIG. 3.

Looking to FIG. 4 the rear surface of the frame 64 is shown. In this example, the frame 64 is also cast as a unitary body to which the driver 68, high-frequency element/driver 70, and control assembly 98 are attached. As with the casing 22, the frame 64 may comprise ridges 100, 102, and/or 104 for rigidity and structural integrity.

The control assembly 98 in one form may be coupled to the external studs 36 (FIG. 11) through internal studs 106. In one form, the control package 98 comprises a transformer 108 and coil 110 to manipulate the acoustic signal received at the internal studs 106 which in turn actuates the drivers 68 and 70.

One example of a speaker mounting system is also disclosed. In this disclosure, the term "portrait" will be used to define an orientation where the long side 118 (FIG. 8) of the casing 22 is generally vertical, and the short side 120 (FIG. 9) is generally horizontal. The term "landscape" will be used to define an orientation where the long side 118 of the casing 22 is generally horizontal, and the short side 120 is generally vertical. As previously mentioned, the mounting system as shown in FIGS. 8-14 may include several attachment positions for the bracket 54. The attachment positions 40-46 are shown best in FIG. 1, while the bracket 54 is best shown in FIG. 14.

One example of this mounting system allows attachment of the bracket 54 in several different positions on the casing 22 so that the speaker system 20 may be wall-mounted or free-standing in several different orientations.

In one form as shown in FIG. 8, the bracket 54 is attached at the landscape flat attachment position 40 and the distal end 112 of the bracket 54 rests upon a horizontal surface 114 in a landscape orientation without attachment to the horizontal surface 114.

In one form as shown in FIG. 9, the bracket 54 is attached at the portrait flat attachment position 42 and the distal end 112 of the bracket 54 rests upon the horizontal surface 114 in a portrait orientation without attachment to the horizontal surface.

Figure 10:
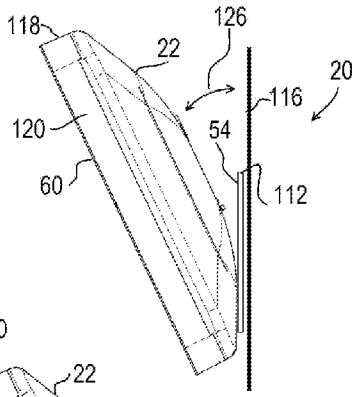
FIG. 10 is a side parallel view of the example shown in FIG. 1 in a landscape angled mounted position.

FIG. 10 shows that in one example attachment of the bracket 54 at the landscape flat attachment position 44 allows the speaker assembly to be mounted to a vertical surface 116 where the front face panel 60 of the speaker system 20 is at a substantial angle 126 to the vertical surface 116 in a landscape orientation. In one example, the t-slots 58 allow for removable attachment to the vertical surface 116. The bracket 54 may be bent, attached in other ways, or other adjustments may be made to alter the angle 126.

FIG. 11 shows that in one example the portrait flat attachment position 42 allows the speaker assembly 20 to be mounted to a vertical surface 116 where again the front face panel 60 of the speaker system 20 is at a substantial angle 126 to the vertical surface 116 in a portrait orientation. In one example, the t-slots 58 allow for removable attachment to the vertical surface 116. Again, the bracket 54 may be bent, attached in other ways, or other adjustments may be made to alter the angle 126.

Figure 12:
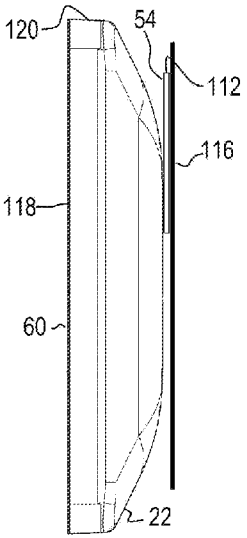
FIG. 12 is a side parallel view of the example shown in FIG. 1 in a portrait flat mounted position.

FIG. 12 shows that in one example, attachment of the bracket 54 to the portrait flat attachment position 42 allows the speaker casing 22 to be mounted to a vertical surface 116 where the front face panel 60 of the speaker system 20 is substantially parallel to the vertical surface 116 in a portrait orientation. The bracket 54 may also comprise a hook or other structure to form a suspension point to "hang" the speaker system from a bar or other support structure.

Figure 13:
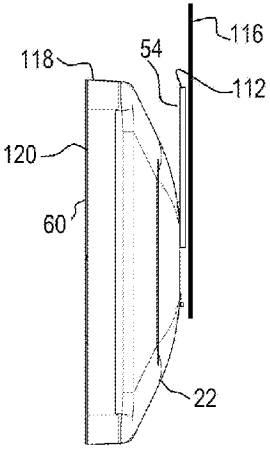
FIG. 13 is a side parallel view of the example shown in FIG. 1 in a landscape flat mounted position.

FIG. 13 shows that in one example, attachment of the bracket 54 at the landscape flat attachment position 40 allows the speaker casing 22 to be mounted to a vertical surface 116 where the front face panel 22 of the speaker system 20 is substantially parallel to the vertical surface 116 in a landscape orientation.

Figure 15:
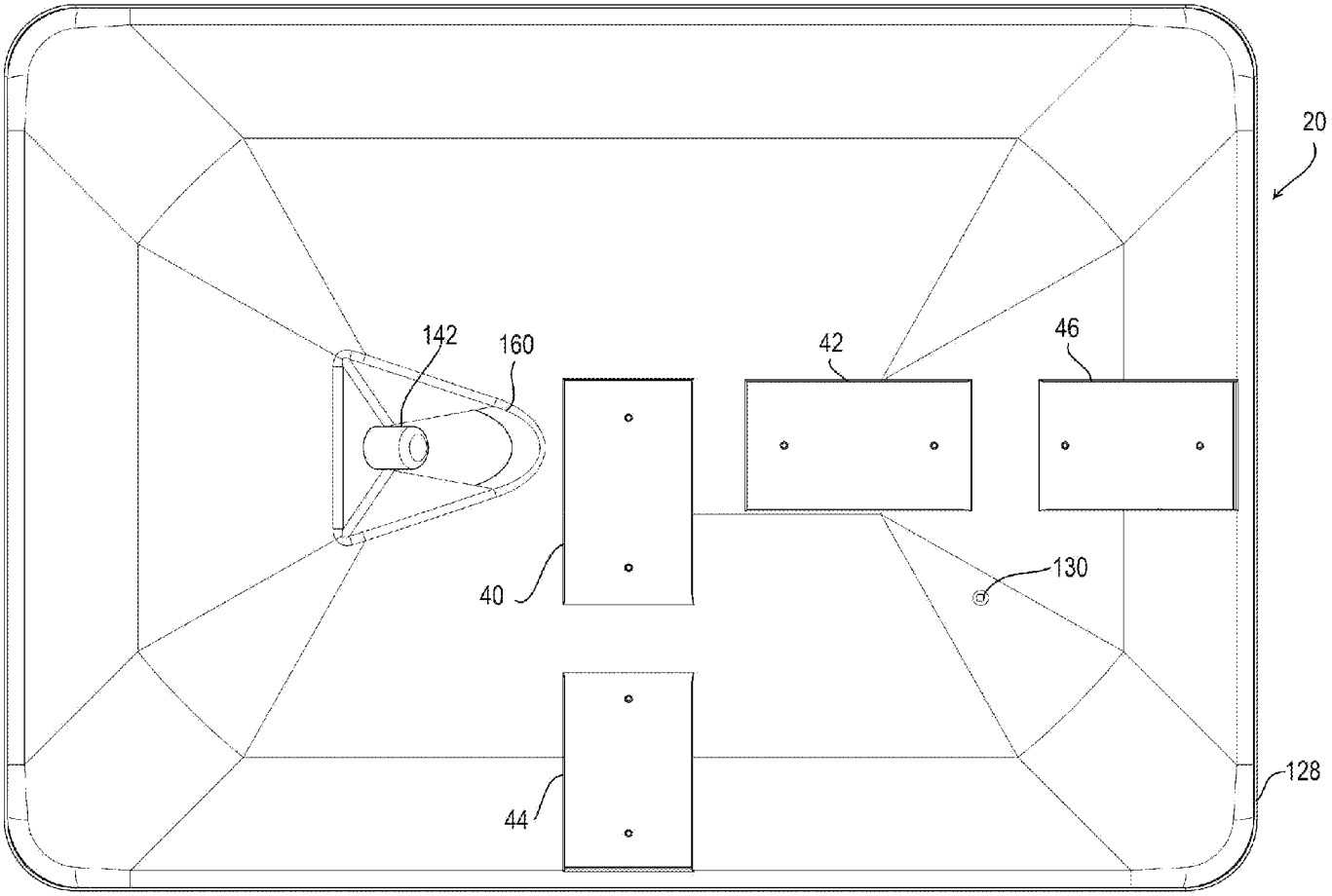
FIG. 15 is a rear view of another example of the disclosed apparatus.
Figure 18:
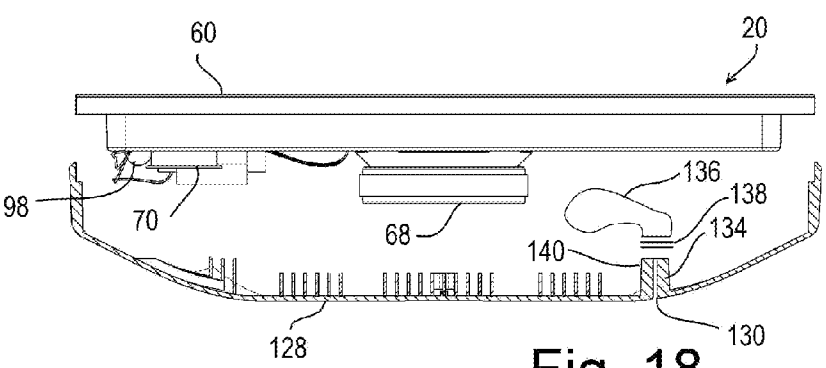
FIG. 18 is a side cutaway view of the example shown in FIG. 15 partially disassembled.
Figure 19:
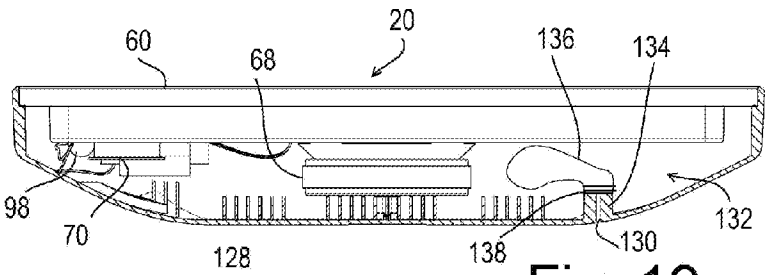
FIG. 19 is an assembled view of the example shown in FIG. 18.

Looking to FIG. 15 is shown an alternate example of the waterproof speaker system 20 comprising a rear casing 128 very similar in form to the rear casing 22 previously described with a few functional modifications. In particular, a through port 130 is provided to allow fluid flow into the interior portion 132 of the speaker system. In one form, a fitting 134 is provided on the interior portion of the casing 128. A pressure bladder 136 may be attached to the fitting 134 such as by adhesives or an elastic band 138 fitted to a circumferential channel 140 about the fitting 134. The pressure bladder 136 may be elastic such as a balloon, or non-elastic.

The pressure bladder 136 allows air to enter and exit the interior portion 132 of the speaker assembly 20 to avoid pressure differentials between the interior portion 132 and the exterior of the speaker assembly. It has been found that for example when the speaker assembly without such a pressure baffle 136 is exposed to an environment of very low or very high temperature relative to the temperature in which it was assembled/sealed, a high internal/external pressure differential may be experienced. Such large pressure differentials may be noticeably detrimental to the function and lifespan of the speaker assembly 20. For example, a large pressure differential may be terminally detrimental to the seal(s) of the casing which would then allow water or water vapor into the interior portion 132 thus oxidizing and otherwise compromising the delicate components therein such as the control assembly 98, driver 68, and driver 70.

Figure 16:
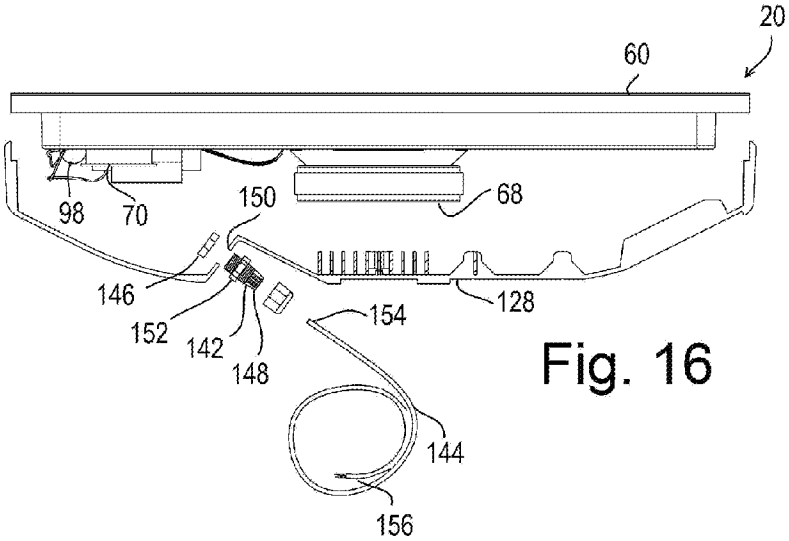
FIG. 16 is a top cutaway view of the example shown in FIG. 15 partially disassembled.
Figure 17:
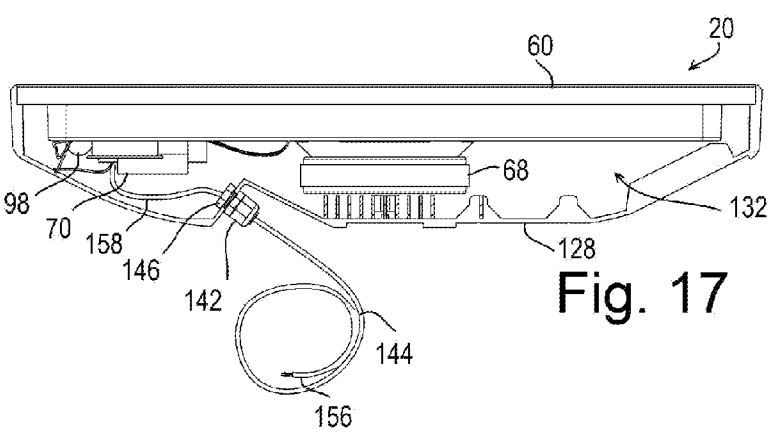
FIG. 17 is an assembled view of the example shown in FIG. 16.

Another improvement to watertight integrity is shown in FIGS. 16 and 17 comprising a watertight fitting 142 and control wire (pigtail) physically and electrically attached thereto. A wiring recess 160 may be provided in the rear casing 128 in a similar manner to the wiring recess 30 previously described to functionally and visually hide the male fitting 142. In this example, the fitting 142 comprises a female threaded ring 146 on the interior portion 132 of the speaker assembly which threads onto a male fitting stud 148. In one form, a seal such as a malleable gasket or volume of curing sealant may be disposed to seal the fitting 142 to the surface defining a void 150 in the rear casing 128. A wire or cable 158 may electrically connect the fitting 142 to the audio electronics control assembly 98. A female threaded ring 152 may also be utilized to adjust and/or seal the fitting 142 to the exterior side of the casing 128 adjacent the void 150. The pigtail 144 may comprise a first end 154 electrically and physically connected to the fitting 142 and a second end 156 for electrical connection to an audio signal device such as a radio, television, public announcement device, or other sound system component capable of producing or transmitting an electronics audio signal to the electronics control package 98 or directly to the drivers 68/70.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and method Komatex and illustrative examples shown and described. Accordingly, departures may be made from such details without departing from the spirit or scope of applicants' general concept.

Therefore I claim:

1. A waterproof speaker system comprising:

a. a water impermeable rear casing, cast as a unitary body with a rear panel and side panels substantially orthogonal to the rear panel;

b. a front frame sealed to the rear casing;

c. a water impermeable front face panel sealed to a perimeter face of the front frame;

d. wherein a low frequency first speaker driver is attached to the surface defining the driver void forward of the rear casing and rearward of the front face panel such that the low frequency first speaker driver is not in contact with the front face panel;

e. wherein a rear surface of the front face panel, a front surface of the front frame, a front surface of the low frequency first speaker driver and an offset edge define an offset void allowing the front face panel to oscillate without contacting the front frame nor the low frequency first speaker driver;

f. a surface defining an unrestricted-flow port through the rear casing with a volume expanding bladder attached to an interior portion of the unrestricted-flow port; and g. a speaker wiring fitting sealed to and projecting through the rear casing to provide electrical communication to the low frequency first speaker driver.

2. The waterproof speaker system as recited in claim 1 further comprising a resilient member compressed between a rear surface of the low frequency first speaker driver and a front facing surface of the rear casing.

3. The waterproof speaker system as recited in claim 2 wherein the resilient member is adhered to one or both of the rear surface of the low frequency first speaker driver and a front facing surface of the rear casing.

4. The waterproof speaker system as recited in claim 3 comprising a compressible foam tape with adhesive on both sides thereof providing adhesion between the rear surface of the low frequency first speaker driver and front facing surface of the rear casing.

5. The waterproof speaker system as recited in claim 1 further comprising a volume of a water impermeable sealant between a perimeter edge of the front frame and an interior surface of the rear casing.

6. The waterproof speaker system as recited in claim 1 further comprising a volume of water impermeable sealant between the front face panel and the front frame.

7. The waterproof speaker system as recited in claim 1 further comprising a second speaker driver having a front surface in contact with the rear surface of the front face panel.

8. The waterproof speaker system as recited in claim 1 wherein the rear casing is cast of Acrylonitrile Styrene Acrylate (ASA) Plastic.

9. A waterproof and hermetically sealed speaker system comprising:

a. a water and air impermeable rear casing, cast as a unitary body with a rear panel and side panels substantially orthogonal to the rear panel;

b. a front frame sealed to the rear casing;

c. a water and air impermeable front face panel hermetically sealed to a perimeter face of the front frame;

d. wherein a low frequency first speaker driver is attached to the surface defining the driver void forward of the rear casing and rearward of the front face panel such that the low frequency first speaker driver is not in contact with the front face panel;

e. wherein a rear surface of the front face panel, a front surface of the front frame, a front surface of the low frequency first speaker driver and an offset edge define an offset void allowing the front face panel to oscillate without contacting the front frame nor the first speaker driver;

f. a surface defining an unrestricted-flow port through the rear casing with a volume expanding bladder attached to an interior portion of the unrestricted-flow port; and g. a speaker wiring fitting sealed to and projecting through the rear casing to provide electrical communication to the low frequency first speaker driver.

* * * * *